US012195983B2

(12) United States Patent
Strout

(10) Patent No.: US 12,195,983 B2
(45) **Date of Patent: *Jan. 14, 2025**

(54) METHOD AND DEVICE FOR MINIMALLY INVASIVE CONSTRUCTION OF ADDITIONAL LEVEL ON A BUILDING

(71) Applicant: BOS Designs, LLC, Homewood, AL (US)

(72) Inventor: Benjamin Ora Strout, Homewood, AL (US)

(73) Assignee: BOS Designs, LLC, Homewood, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/358,512

(22) Filed: Jul. 25, 2023

(65) Prior Publication Data

US 2023/0366223 A1 Nov. 16, 2023

Related U.S. Application Data

(63) Continuation of application No. 17/888,128, filed on Aug. 15, 2022, now Pat. No. 11,746,544, which is a (Continued)

(51) Int. Cl.

| | |
|---|---|
| ***E04G 21/16*** | (2006.01) |
| ***E04B 1/10*** | (2006.01) |
| ***E04B 1/26*** | (2006.01) |

(52) U.S. Cl.

CPC ..... *E04G 21/163* (2013.01); *E04B 1/10* (2013.01); *E04B 2001/2644* (2013.01); *E04B 2001/2652* (2013.01); *E04B 2001/266* (2013.01)

(58) Field of Classification Search

CPC ..... E04B 1/10; E04B 1/3511; E04B 1/3522; E04B 1/3527; E04B 2001/266;

(Continued)

(56) References Cited

U.S. PATENT DOCUMENTS 5,561,950 A * 10/1996 Collins ..... E02D 27/32 248/354.3
5,839,239 A * 11/1998 Jang ..... E04B 1/3511 52/749.1

(Continued)

FOREIGN PATENT DOCUMENTS

FR 2581112 A1 * 10/1986

OTHER PUBLICATIONS

International Search Report and Written Opinion issued in PCT Application No. PCT/US2022/019899, mailing date Jun. 9, 2022, 10 pages.

*Primary Examiner* — Christine T Cajilig
(74) *Attorney, Agent, or Firm* — King & Spalding

(57) ABSTRACT

In several embodiments, the disclosed process may include installing one or more householder devices onto load-bearing structures of a building, installing one or more perimeter beams onto the one or more householders, installing a new exterior assembly onto the one or more perimeter beams, removing an existing roof, and constructing an additional level on the building. In at least one embodiment, installing the one or more householders onto the load-bearing structure may include cutting a hole in the existing roof above the load-bearing structure, attaching the householder onto the load-bearing structure, and sealing the hole around the householder. In some embodiments, the new exterior assembly may be partially or fully constructed on site and may be installed onto the one or more perimeter beams. In some embodiments, once the new exterior assembly is installed, the old roof may be removed from underneath the new exterior assembly.

9 Claims, 7 Drawing Sheets

Related U.S. Application Data continuation of application No. PCT/US2022/019899, filed on Mar. 11, 2022.

(60) Provisional application No. 63/163,476, filed on Mar. 19, 2021.

(58) Field of Classification Search
CPC ..... E04B 2001/2644; E04B 2001/2652; E04B 2001/3561; E04G 21/163; E04G 23/0266
See application file for complete search history.

(56) References Cited

U.S. PATENT DOCUMENTS

| | | | | |
|---|---|---|---|---|
| 6,347,489 | B1 * | 2/2002 | Marshall, Jr. | E02D 27/00 52/126.6 |
| 9,637,361 | B2 * | 5/2017 | Long | B66F 3/08 |
| 2003/0033772 | A1 | 2/2003 | Russell | |
| 2006/0010825 | A1 | 1/2006 | Schubert | |
| 2012/0079776 | A1 | 4/2012 | Beattie | |
| 2014/0260070 | A1 * | 9/2014 | Barcroft | B66F 3/00 52/741.1 |
| 2015/0204091 | A1 * | 7/2015 | Long | B66F 3/10 52/741.1 |
| 2017/0342728 | A1 * | 11/2017 | Wensel | E04G 21/163 |

* cited by examiner

METHOD AND DEVICE FOR MINIMALLY INVASIVE CONSTRUCTION OF ADDITIONAL LEVEL ON A BUILDING

RELATED APPLICATIONS

The present application is a continuation of U.S. patent application Ser. No. 17/888,128, entitled "METHOD AND DEVICE FOR MINIMALLY INVASIVE CONSTRUCTION OF ADDITIONAL LEVEL ON A BUILDING," filed Aug. 15, 2022, which is a continuation of and claims priority to PCT/US2022/019899, entitled "METHOD AND DEVICE FOR MINIMALLY INVASIVE CONSTRUCTION OF ADDITIONAL LEVEL ON A BUILDING," filed on Mar. 11, 2022, which claims the benefit of priority to U.S. Provisional Application No. 63/163,476, entitled "TWO-PART LOAD TRANSFER DEVICE FOR USE IN SECOND STORY ADDITION CONSTRUCTION", filed on Mar. 19, 2021, the entirety of which is incorporated herein by reference.

TECHNICAL FIELD

The present disclosure generally relates to construction processes and devices, and more particularly to building level addition processes and associated devices.

BACKGROUND

For homeowners that desire to expand the size of their houses, but do not have enough land area to expand their houses horizontally or would rather not cover more of their lot, adding an additional level onto their homes is the only solution to achieve the house expansion. When adding an additional level to an existing home with a pitched roof, the conventional method teaches to first remove the existing roof, then add the new additional level, and then add the new roof. Using the conventional method, until the new roof is finally constructed and placed on the home, the interior spaces, appliances, and materials of the existing building are constantly exposed to the weather conditions, and often this weather exposure occurs for a significant amount of time. This weather exposure often leads to water and other undesirable elements intruding into the home, potentially destroying or damaging the components within the building.

Additionally, the conventional method also requires the residents to vacate the house while construction is underway, because the home is not habitable while there is no roof on the house. The conventional method often takes weeks or months to complete, meaning that the residents cannot live in their home during this slow process. Construction workers also work in the weather elements, and bad weather can cause additional delays.

Therefore, there is a long-felt but unresolved need for a process and device that allows for the new roof to be added to the home before the old roof is removed so that the weather exposure is minimized, and the residents do not have to vacate the home during construction.

BRIEF SUMMARY

Briefly described, and according to one embodiment, aspects of the present disclosure generally relate to construction processes, systems, and devices, and more particularly to building level addition processes and associated devices.

In various embodiments, the disclosed process may allow for the construction of an additional level onto a building that has an exterior load-bearing wall system (i.e., the exterior walls of the building carry the load of the building), before removing the existing roof In multiple embodiments, buildings with an exterior load-bearing wall system may include pitched-roof or conventionally framed residential houses and smaller commercial buildings. In one or more embodiments, the disclosed process ensures that weather exposure in the interior of the building is minimized by adding a new exterior assembly, which may include a new roof that may or may not be attached to new vertical walls, onto the building before removing the old roof. In some embodiments, installing the new exterior assembly over the existing roof creates a dry space between the old roof and the new exterior assembly that construction workers can work in regardless of the outside weather. In many embodiments, the disclosed process may allow the residents to remain in their homes or workers to continue to work in the commercial buildings during the construction process because the buildings are not without a roof during the disclosed process, which saves the residents money and convenience because they do not have to move out into a short-term rental unit or hotel.

In several embodiments, the disclosed process does not require breaching the existing interior space of the building to add another story to a building until the additional level is constructed, or partially constructed, preserving the existing interior living space throughout the renovation process. In one or more adjustable foundation devices ("householders") onto the existing load-bearing structure(s) of the building, installing one or more perimeter beams onto the householders, and installing the new exterior assembly onto the one or more perimeter beams supported by the one or more householders. In at least one embodiment, the disclosed system includes making minimally invasive holes (one hole per householder) in the existing roof and above the load-bearing structure, placing the householder through the hole then attaching the householder to the load-bearing structure, and sealing the hole to keep water and other debris out of the home.

For several different reasons, buildings may not be level in one or more areas of the building. In multiple embodiments, the disclosed process also may include adjusting the height of each of the one or more householders so that each householder is leveled with each other to provide a level load-bearing datum for the addition of a new habitable space above the existing habitable level. In some embodiments, once the new exterior assembly is placed onto the one or more householders, the additional level may be constructed, and the old roof removed.

According to one aspect, a method for constructing an additional level in a building, including: installing one or more householders onto an existing roof of the building; installing one or more perimeter beams onto the one or more householders; installing a new exterior assembly onto the one or more perimeter beams; removing the existing roof from the building; and constructing an additional level within the building.

According to another aspect, the method of this aspect or any other aspect, wherein the existing roof is removed from the building before the additional level is constructed within the building.

According to yet another aspect, the method of this aspect or any other aspect, wherein portions of the existing roof are removed from the building as portions of the additional level are constructed within the building.

According to yet another aspect, the method of this aspect or any other aspect, wherein installing one or more householders includes: cutting one or more roof holes through the existing roof of the building; inserting the one or more householders into the existing roof through the one or more roof holes; attaching the one or more householders to a load-bearing structure of the building; and sealing the one or more roof holes.

According to yet another aspect, the method of this aspect or any other aspect, further including leveling each of the one or more householders prior to installing the one or more perimeter beams.

According to yet another aspect, the method of this aspect or any other aspect, wherein leveling each of the one or more householders includes adjusting a leveling mechanism on each of the one or more householders.

According to yet another aspect, the method of this aspect or any other aspect, wherein each of the one or more householders include an attachment point.

According to yet another aspect, the method of this aspect or any other aspect, further including attaching a winch and flexible line to the attachment points of the one or more householders to stabilize the one or more perimeter beams during the new roof installation.

According to yet another aspect, the method of this aspect or any other aspect, further including attaching a winch and flexible line to the one or more perimeter beams to stabilize the one or more perimeter beams during the new roof installation.

According to yet another aspect, the method of this aspect or any other aspect, wherein each of the one or more householders includes: a beam mounting bracket, wherein the beam mounting bracket includes a rigid vertical member, a rigid horizontal base member, and a rigid tube sleeve; a leveling mechanism, wherein the leveling mechanism operatively connects with the rigid tube sleeve; and a base mounting bracket, wherein the base mounting bracket includes a base plate and a base mounting rod protruding from the base plate, wherein the base mounting rod operatively connects with the leveling mechanism.

According to yet another aspect, the method of this aspect or any other aspect, wherein the leveling mechanism includes a hollow body with a machine threaded interior surface, and the base mounting rod includes an exterior machine threaded surface, wherein the interior threaded surface of the leveling mechanism mates with the machine threaded exterior surface of the base mounting rod.

According to yet another aspect, the method of this aspect or any other aspect, wherein the rigid vertical member includes a vertical fastening plate, one or more vertical fastening support plates, and an attachment point protruding from the vertical fastening plate, wherein the vertical fastening plate defines one or more fastening holes for fastening the rigid vertical member to the one or more perimeter beams.

According to one aspect, a householder device, including: a base mounting bracket; an adjustment collar; and a beam mounting bracket, wherein the base mounting bracket is attached to a load-bearing structure of a building and the beam mounting bracket receives one or more perimeter beams for constructing a new level on the building.

According to another aspect, the householder device of this aspect or any other aspect, wherein the base mounting bracket further includes a base plate and a base mounting rod, wherein the base mounting rod extends vertically from the base plate and operatively connects to the adjustment collar.

According to yet another aspect, the householder device of this aspect or any other aspect, wherein the beam mounting bracket further includes a rigid vertical member, a rigid horizontal base member, and a rigid tube sleeve, wherein the rigid horizontal member includes a top surface that receives the one or more perimeter beams, and the rigid tube sleeve operatively connects with the adjustment collar.

According to yet another aspect, the householder device of this aspect or any other aspect, wherein the adjustment collar further includes a cylindrical hollow body with a first end and a second end and defines a circular opening at each of the first and second ends, wherein the interior surface of the hollow body is machine threaded.

According to yet another aspect, the householder device of this aspect or any other aspect, wherein the base mounting rod includes a cylindrical body having an exterior machine threaded surface, wherein a diameter of the base mounting rod cylindrical body is smaller than a diameter of the openings of the adjustment collar so that the base mounting rod fits into an interior space of the adjustment collar.

According to yet another aspect, the householder device of this aspect or any other aspect, wherein the rigid vertical member includes a vertical fastening plate, one or more vertical fastening wall support plates, a D-ring element protruding from the vertical fastening plates, and wherein the vertical fastening plate defines one or more fastening holes.

According to yet another aspect, the householder device of this aspect or any other aspect, wherein the rigid vertical member includes a height of 10 inches to forty-eight inches and a width of two inches to twenty-four inches.

According to yet another aspect, the householder device of this aspect or any other aspect, wherein the rigid horizontal base member includes a width of two inches to twenty-four inches.

According to yet another aspect, the householder device of this aspect or any other aspect, wherein the base plate includes a length of six inches to thirty-two inches.

According to yet another aspect, the householder device of this aspect or any other aspect, wherein the base plate defines one or more attachment holes for attaching fasteners through the base plate to the load-bearing structure.

BRIEF DESCRIPTION OF THE DRAWINGS

The accompanying drawings illustrate one or more embodiments and/or aspects of the disclosure and, together with the written description, serve to explain the principles of the disclosure. The elements and features shown in the drawings are not necessarily to scale, emphasis instead being placed upon clearly illustrating the principles of the exemplary embodiments. Additionally, certain dimensions or positions may be exaggerated to help visually convey such principles. Wherever possible, the same reference numbers are used throughout the drawings to refer to the same or like elements of an embodiment, and wherein.

DETAILED DESCRIPTION

Figure 1:
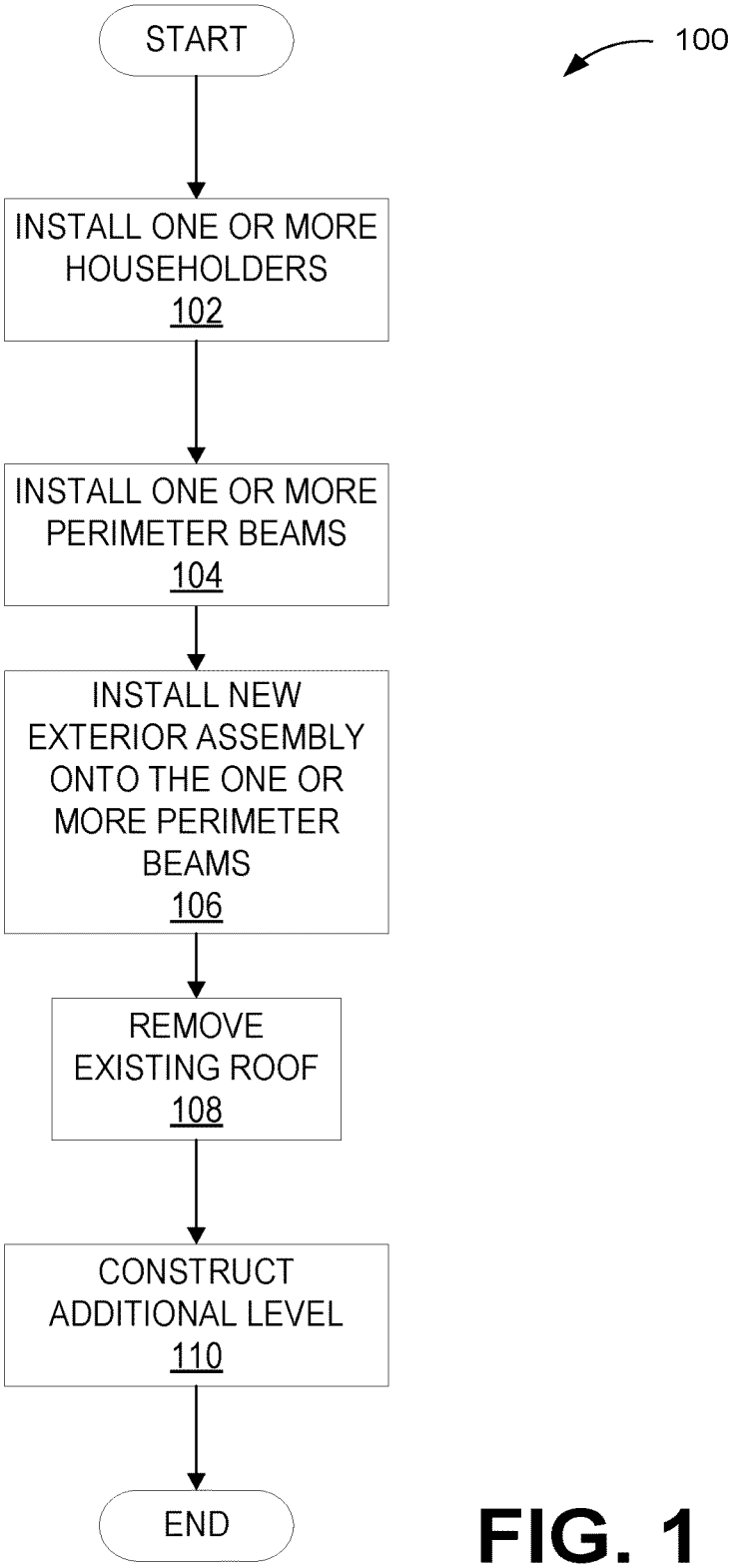
FIG. 1 is a flowchart depicting a disclosed process for installing an additional story onto a building, according to one embodiment of the present disclosure.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with and as expressed in the claims.

Whether a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

OVERVIEW

Aspects of the present disclosure generally relate to construction processes, systems, and devices, and more particularly to residential home level addition processes and associated devices. In various embodiments, a construction crew may utilize the disclosed level addition process and associated householder devices to construct an additional story on a residential home or other similar commercial building. In at least one embodiment, when adding an additional story onto a residential home or other similar building, the existing roof is removed because there is not enough height or space between the existing ceiling of the level below (or the floor of the additional level if constructed) and the underside of the existing roof to construct a habitable additional level. In one or more embodiments, the new exterior assembly to be installed may include a new roof with a higher pitch than the existing roof, creating a larger height difference between the ceiling of the existing level so that when the additional level is constructed, the height difference between the underside of the newly installed roof and the newly constructed additional level allows for a habitable living space. In another embodiment, the new exterior assembly to be installed may include a new roof attached to vertical perimeter walls, such that the new roof may have the same, higher, or lower pitch as the existing roof, and the vertical perimeter walls create the height difference between the underside of the newly installed roof and the existing roof.

In several embodiments, a roof may include an outer cladding (e.g., shingles, plywood, etc.) to keep water and other debris out of the enclosure, an outer framing, which gives the roof shape and structure, a bottom chord, which is horizontally-attached, building materials (e.g., 2×4 lumber, etc.) that ceiling panels attach to on one side, and webbing, which is wood or other building materials that are placed between the framing and bottom chord to distribute the load and provide additional support.

In multiple embodiments, the disclosed process may be performed on existing conventional residential stick-framed (pitched-roof) buildings and similarly built commercial buildings. In at least one embodiment, the buildings may include, but are not limited to, buildings with a gable roof, hip roof, Dutch roof, Mansard roof, flat roof, shed roof, butterfly roof, Gambrel roof, Dormer roof, and M-shaped roof. In many embodiments, the existing, old roof on the building may include load-bearing structures that the old roof is connected to. In one or more embodiments, the disclosed process allows for the new roof to be installed on the existing load-bearing structure of the building. In at least one embodiment, the new roof may include outer framing of the new roof and outer cladding (e.g., shingles and plywood), and may also include vertical walls.

In several embodiments, the disclosed process may include installing one or more householder devices ("householders") onto the load-bearing structure of the building, installing one or more perimeter beams onto the one or more householders, installing the new roof onto the one or more perimeter beams, removing the old roof, and constructing the additional level. In at least one embodiment, installing one or more householders onto the load-bearing structure may include cutting a hole in the old roof above the load-bearing structure, attaching the householder onto the load-bearing structure, and sealing the hole around the householder so that water or other weather elements cannot intrude into the home. In some embodiments, the new exterior assembly (including at least the new roof, but also may include vertical perimeter walls attached to the new roof) may be partially or fully constructed on site and a crane or other tool may be used to place the new assembly onto the perimeter beams, or the new exterior assembly may be constructed over the existing roof. In some embodiments, once the new exterior assembly is installed/constructed, the old roof may be removed from underneath the new exterior assembly.

In various embodiments, the one or more householder devices may be attached to the load-bearing structure in the building. In one or more embodiments, the one or more householders may include a base plate, a receiving plate to receive the perimeter beams, and a leveling apparatus. In at least one embodiment, the householder may also include an attachment point. In many embodiments, the load-bearing structures in the building may not be level, so the leveling apparatus on each householder may allow the receiving plates for the one or more householders to be moved vertically so that each receiving plate is level.

In many embodiments, the disclosed process allows for the tenants of the building to stay in the building during the construction process because the building always has a fully functional roof during the process. In some embodiments, because there is a fully functional roof on the building through the disclosed process, the risk of weather elements, such as rain or wind debris, entering the building is greatly reduced compared to the conventional process.

EXEMPLARY EMBODIMENTS

Referring now to the figures, for the purposes of example and explanation of the fundamental processes and components of the disclosed methods, systems, and devices, reference is made to FIG. 1, which illustrates an exemplary, high-level process 100 of one embodiment of the disclosed process. As will be understood and appreciated, the exemplary, high-level process 100 shown in FIG. 1 represents merely one approach or embodiment of the present method, and other aspects may be used according to various embodiments of the present method.

As shown in FIG. 1, a disclosed process 100 for installing an additional story onto a building is described, according to one embodiment of the present disclosure. In various embodiments, the disclosed process 100 allows a building to always have a fully functioning roof during the construction of a new story addition onto an existing building. In several embodiments, a contractor or other user of process 100 may determine that the building can support the weight of an additional story and that the addition of the story does not violate any local building codes prior to step 102.

Figure 2:
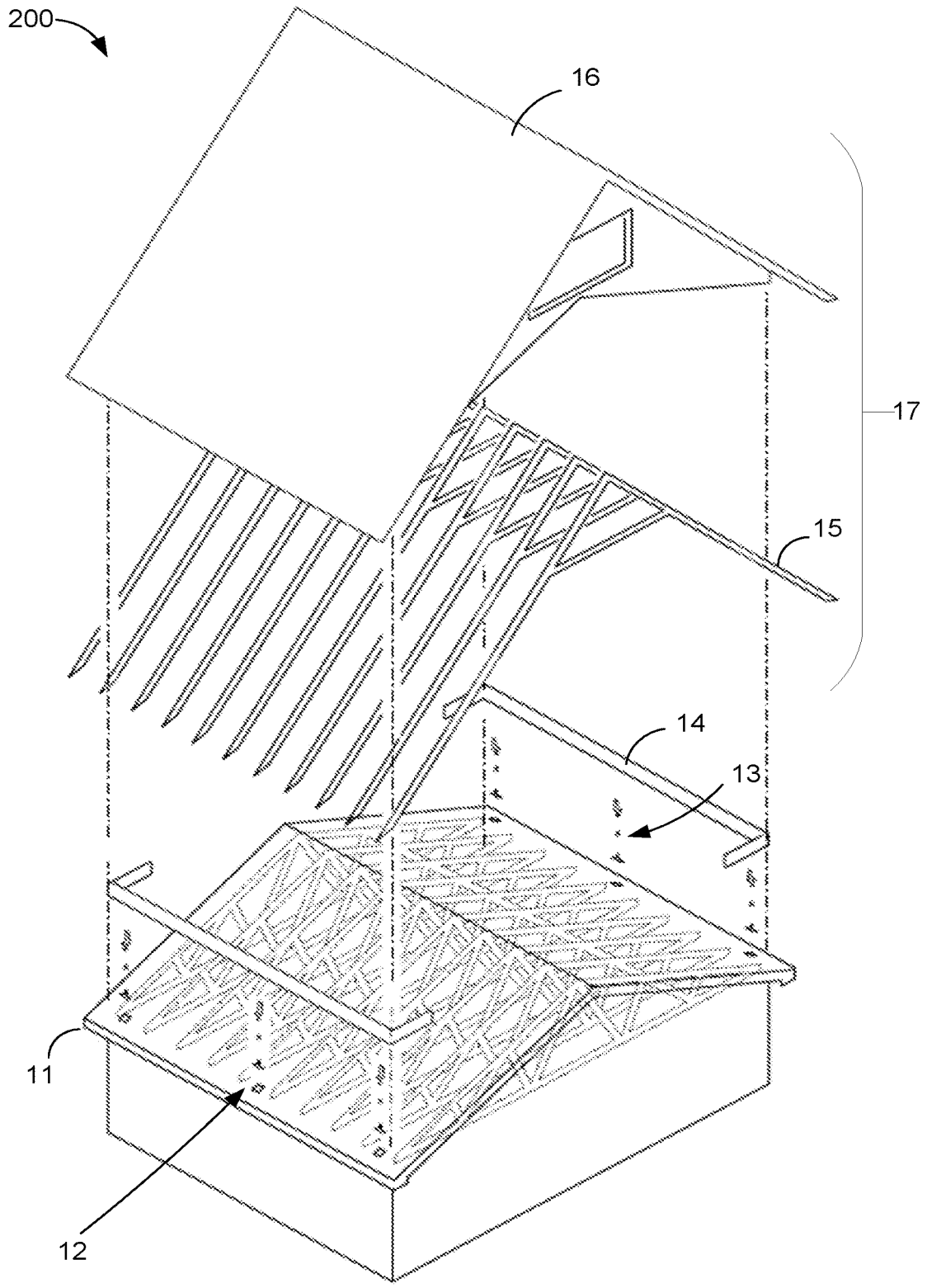
FIG. 2 is an exploded view of an exemplary building with a new roof installed via the disclosed process, according to one embodiment of the present disclosure.

According to one embodiment, at step 102 of process 100, a user may install one or more householders 13 (as shown in FIG. 2). In at least one embodiment, to install the one or more householders 13, one or more roof holes 12 (as shown in FIG. 2) may be cut into an existing roof 11 (as shown in FIG. 2) (also referred to herein as the "first roof" or "old roof"), so that a householder 13 may be inserted through the existing roof 11 via hole 12 and be attached to the load-bearing structure. In some embodiments, the number of one or more roof holes 12 corresponds to the number of one or more householders 13 installed. In one or more embodiments, each roof hole 12 is cut above the load-bearing structure of the building 200 so that a part of an individual householder 13 may be placed through roof hole 12 and attached onto the load-bearing structure. In certain embodiments, the one or more householders 13 may be attached to the load-bearing structure via screws, bolts, nails, or other similar fasteners. In one embodiment, each of the one or more roof holes 12 may be sized so that each roof hole 12 can be weather sealed.

In a preferred embodiment (as shown in FIG. 2), a plurality of householders 13 are installed symmetrically on two opposing sides of a building. For example, in a preferred embodiment shown in FIG. 2, three householders 13 are installed on one side of the building 200 and three householders 13 are installed on the directly opposing side of the building 200, and each of the three householders 13 have generally the same distance between each other as the counterpart three householders 13. However, in alternative embodiments, one or more householders 13 may be installed on only one side of a building, or on as many sides of a building and in any configuration as needed to support the new exterior assembly 17. For example, in an alternative embodiment, a building may be triangular shaped, such that to perform the process 100, one or more householders 13 may be installed on each of the three sides of the triangular-shaped building.

In several embodiments, the number of householders 13 installed on a side of a building on a load-bearing structure may be determined by the size of the perimeter beam 14 and standardized spacing. In some embodiments, the number of householders 13 installed on a side of a building on a load-bearing structure may be the length of the load-bearing structure divided by a standard length (e.g., 2 feet, 6 feet, 8 feet, 12 feet, 20 feet, or any distance in between), and the resulting number of householders 13 to be installed may be equally spaced out between each other on the load-bearing structure. In at least one embodiment, the distance between any two installed householders 13 and the number of householders 13 installed on a load-bearing structure may be determined by engineering considerations. In some embodiments, the number of householders 13 to be installed on a load-bearing structure and the distance between each householder 13 may be determined by dividing the total weight of the new level addition and new exterior assembly 17 by the safe operational point load limit of the existing load-bearing structures in the building to determine the number of householders 13 to be installed, and dividing the length of the one or more perimeter beams 14 to be installed by the number of householders 13 to be installed to determine the average distance between each householder.

Figure 4:
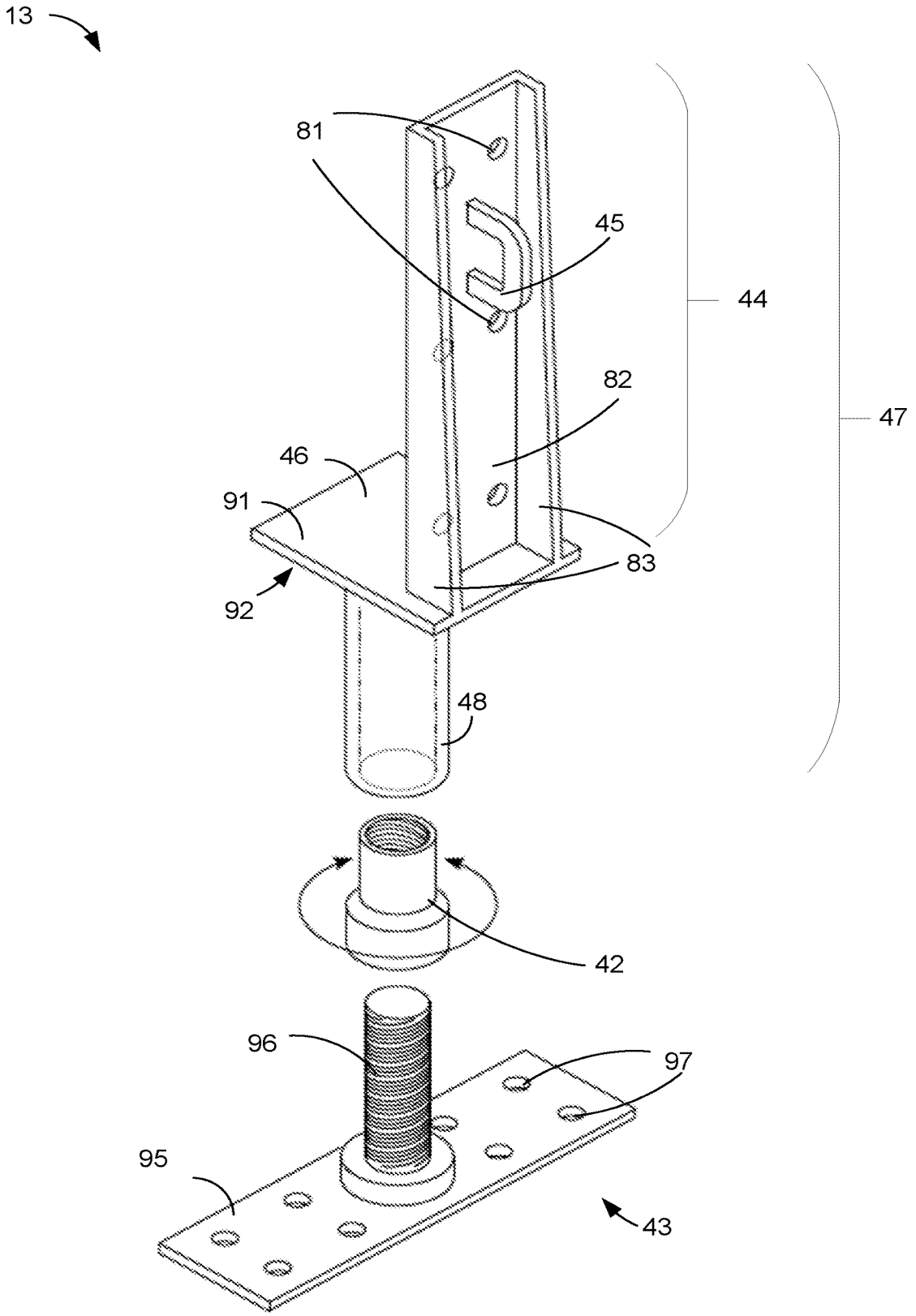
FIG. 4 is an exploded view of an exemplary householder, according to one embodiment of the present disclosure.

In one or more embodiments, the one or more householders 13 may be leveled via a leveling mechanism. In at least one embodiment, the one or more householders 13 are considered level when the top surface of the rigid horizontal base member 46 (as shown FIG. 4) of each of the one or more householders 13 are approximately level with each other, or when the leveling mechanisms on each of the one or more householders 13 are determined to be level with each other. In many embodiments, the leveling mechanism may be manually operated by a user or may include a system that automatically levels each of the householders 13. For example, the leveling mechanism may be an adjustment collar 41 on the householder 13 (as shown in FIG. 4) that a user may rotate or cause to be rotated (e.g., controlling a motor that causes the adjustment collar 41 to rotate) to raise or lower the beam mounting bracket 47 of the householder 13. In other embodiments, the leveling mechanism may be a hydraulic system or a series of levers.

In many embodiments, a user may utilize a laser and/or surveyor level to determine that the one or more householders 13 are level. In at least one embodiment, the user may install a water level system that assists the user in determining whether a householder 13 is level with another householder 13. In one or more embodiments, the water level system may include a series of interconnected tubes filled with water, in which each householder 13 has a tube attached. The user may fill the series of interconnected tubes with water until the water in the tubes is at a certain leveling height (due to water pressure, the water level of each tube at each householder will be the same), and then may adjust the leveling mechanisms on each of the installed householders 13 until the beam mounting bracket 47 is level with the water in the tube at the certain leveling height. In another embodiment, the user may include electronic devices on each householder that may be able to determine height differentials between each of the one or more householders 13, so that a user may adjust the height of one or more householders 13 to level the householders 13. In one or more embodiments, these leveling systems may be utilized since the existing roof 11 may make leveling opposing householders 13 difficult because the existing roof obstructs the view of the opposing householders 13. In one embodiment, once the user determines that the householder 13 is level, the user may weld the locking mechanism, or otherwise make the locking mechanism fixed, so that the householder 13 cannot thereafter be adjusted vertically.

In several embodiments, once an individual householder 13 is attached to the load-bearing structure, the roof hole 12 may be sealed to prevent water and other weather elements from entering the inside of the building through the roof hole 12. In some embodiments, a portion of the householder 13 may be protruding from the roof hole 12, and so the gap between the protruding householder 13 and the edge of the roof hole 12 may be sealed. In many embodiments, the roof hole 12 may be sealed around the householder 13 using a standard plumbing boot and/or flashing that is integrated with the outer water barrier of the existing roof 11 (e.g., shingles). In one embodiment, the roof hole 12 is weather sealed quickly (e.g., same day) after the householder 13 is installed to minimize exposure time to any dirt, dust, or water from getting into the interior of the building.

In at least one embodiment, the roof hole 12 may be sealed either before or after the householder 13 is leveled, depending on the location of the leveling mechanism (as shown in FIG. 4). For example, in one embodiment, the leveling mechanism may be under the existing roof 11 and require a user to manually interact with the leveling mechanism, such that the householder 13 can only be leveled prior to the roof hole 12 being sealed because the user may not be able to interact with the leveling mechanism after the roof hole 12 is sealed. In an alternate embodiment, the leveling mechanism may be above the existing roof 11, such that the householder 13 can be leveled before or after the roof hole 12 is sealed. In yet another embodiment, the leveling mechanism may include a system that levels the householder 13 such that a user does not manually interact with the leveling mechanism, and thus the location of the leveling mechanism does not affect when the householder 13 is leveled (i.e., the householder 13 may be leveled before or after the roof hole 12 is sealed, even if the leveling mechanism is under the existing roof 11).

According to one embodiment, at step 104 of process 100, a user may install one or more perimeter beams 14 (as shown in FIG. 2) on the one or more householders 13. In at least one embodiment, each side of the building that has one or more householders 13 installed may receive a single perimeter beam 14 or a plurality of perimeter beams 14 placed side-by-side on the one or more householders 13 (e.g., three perimeter beams 14 placed side-by-side such that the resulting plurality of perimeter beams 14 is the same length as one perimeter beam 14, the same height as one perimeter beam 14, and three times the width of one perimeter beam 14). In certain embodiments, the one or more perimeter beam 14 may be attached to the one or more householders 13 by attachments, such as screws, bolts, nails, or other similar fasteners.

In multiple embodiments, the one or more perimeter beams installed on the one or more householders 14 may be designed to receive the new exterior assembly 17 and to receive components for constructing the additional level (e.g., floor joists of the new level). In many embodiments, the one or more perimeter beams 14 may be composed of engineered lumber, steel, carbon fiber, fiberglass, composite concrete, glue laminated beams, or any other material that can hold the additional load of the new exterior assembly 17 and an additional level.

According to one embodiment, at step 106 of process 100, a user may install a new exterior assembly 17 (as shown in FIG. 2) over the existing roof 11. In various embodiments, the new exterior assembly 17 may be constructed on or off site and hoisted via a crane or other lifting device onto the one or more perimeter beams 14. In other embodiments, the new exterior assembly 17 may be fully constructed on the existing building such that no lifting device is needed to install the new exterior assembly 17 (other than lifting devices to assist in lifting individual roofing components).

In multiple embodiments, the new exterior assembly 17 may include an outer cladding 16 attached to an outer framing 15 (as shown in FIG. 2). In at least one embodiment, the outer framing 15 may provide the shape and structure of the new exterior assembly 17. In one or more embodiments, the outer framing 15 is placed on the one or more perimeter beams 14. In certain embodiments, at the point of contact between the outer framing 15 and the one or more perimeter beams 14, the outer framing 15 may include 90-degree cut-outs such that the outer framing 15 has a flat, horizontal surface to sit on the flat, horizontal surface(s) of the top of the one or more perimeter beams 14. In some embodiments, the outer framing 15 may include vertical walls (see FIG. 3F), such that the exterior of the preexisting walls of the building abut with the exterior of the new vertical walls of the outer framing 15. In one embodiment, the outer framing 15 may be installed onto the one or more perimeter beams, and after the outer framing 15 is installed, the outer cladding 16 may be installed onto the outer framing 15. In another embodiment, the outer cladding 16 may be installed on the outer framing 15 prior to installing the outer framing 15 onto the one or more perimeter beams 14.

In several embodiments, the outer cladding 16 is the primary water exclusion system and provides weather protection for the enclosed space during the disclosed process 100 and after the process 100 has concluded. In certain embodiments, the outer cladding 16 may include, but is not limited to, shingles, plywood, metal siding, plastic siding, or other roofing materials as a person having ordinary experience in the art would know. In at least one embodiment, the outer cladding 16 may include a window space for a window, and until the window is installed, the window space may be covered by a material, such as housewrap, tarps, or other materials that prevent water intrusion.

In various embodiments, the initial installation of the new exterior assembly 17 may place a horizontal force on the one or more perimeter beams 14 and the one or more householders 13 that pushes the one or more perimeter beams 14 and one or more householders 13 away from the center of the new exterior assembly 17. In one or more embodiments, during this initial installation, a chain winch 61 and flexible line 62 (see FIG. 6) may be utilized to pull the one or more householders 13 together towards the center of the building to account for the opposing lateral force the installation of the new exterior assembly 17 causes. In many embodiments, a chain winch 61 may be operatively connected to a flexible line 62 (chain, steel cable, woven fiber, etc.), such that an end of the flexible line 62 may attach to an individual householder 13 on one side of the building and an opposing end of the flexible line 62 may attach to a householder 13 on the opposing side of the building, and then winched together to provide the opposing horizontal force. In some embodiments, one chain winch 61 may be connected to all of the one or more householders 13, a plurality of the one or more householders 13, or only two householders 13, via the flexible line 62 or multiple flexible lines 62. For example, in one embodiment, six householders 13 may be installed through the existing roof 11, with three householders 13 on each of two opposing sides of the building, and the chain winch 61 may be connected to all six householders 13 to pull the three householders 13 on the first side towards the three householders 13 on the opposing side (with six flexible lines 62, one flexible line 62 connected to each of the six householders 13). In another example, in certain embodiments, six householders 13 may be installed through the existing roof 11, with three householders 13 on each of two opposing sides of the building, and three chain winches 61 may be utilized. In this embodiment, one chain winch 61 may be connected to one householder 13 on each side of the building via one flexible line 62, thus each of the three chain winches 61 is connected to two householders 13. In another embodiment, the chain winch 61 may be connected, via the flexible line 62, to the one or more perimeter beams 14 after the one or more perimeter beams 14 have been fastened to the one or more householders 13. In this embodiment, the chain winches 61 are still negating the outward forces imposed by the new exterior assembly 17, but the one or more householders 13 are indirectly supported by the fastened one or more perimeter beams 14 from rolling outward.

According to one embodiment, at step 108 of process 100, a user may remove the existing roof 11. In certain embodiments, the existing roof 11 may include cladding, top chords, webs, and bottom chords. In several embodiments, after the new exterior assembly 17 is installed, there exists a space between the top surface of the existing roof 11 and the bottom surface and outer framing 15 of the new exterior assembly 17, such that a user may dismantle the existing roof 11 while under the cover of the new exterior assembly 17. In various embodiments, as the existing roof 11 is being demolished, pieces of the existing roof 11 become unattached, and the user may remove the pieces from the inside of the building. In one or more embodiments, a user may utilize an opening in the new exterior assembly 17, such as a window opening, a gap between the new exterior assembly 17 and the existing roof 11 where water is not at risk of being driven into the new interior by the wind, a temporary opening in the new exterior assembly 17 that will be closed and secured from the elements while the opening is not in use, or an attic opening, to remove the pieces of the dismantled existing roof 11.

In multiple embodiments, the bottom chords of the existing roof 11 may be kept in place. In one or more embodiments, the existing ceiling panels for the preexisting habitable interior space of the building are fastened to the bottom chords of the existing roof 11, so the bottom chords may be kept in place so that the existing ceiling panels are not affected by the construction. In at least one embodiment, the bottom chords may rely on the structure of the framing of the existing roof 11 for the ceiling structural integrity, and thus the bottom chords may be tied into floor joists as the floor joists are installed, to prevent sagging in the existing interior ceiling. In another embodiment, the bottom chords are structurally able to hold the ceiling panels and prevent sagging without tying the bottom chords to the new floor joists for the additional level.

According to one embodiment, at step 110 of process 100, a user may construct an additional level in the building. In multiple embodiments, step 110 may commence once the existing roof 11 is completely dismantled, or steps 108 and 110 may be performed simultaneously or iteratively. In some embodiments, floor joists may be installed onto the one or more perimeter beams 14. In one embodiment, floor joists are horizontal structural members that span the open space between load-bearing structures and are the foundation of the flooring in a building. In one or more embodiments, floor joists may be installed without needing to tie the bottom chords, which are attached to the lower-level ceiling) to the floor joists. In this embodiment, the existing roof 11 may be completely removed prior to constructing the new level because dismantling the existing roof 11 does not affect the structural integrity of the ceiling of the lower existing level (e.g., the bottom chords do not need to be tied to the floor joists).

In another embodiment, if the bottom chords need to be tied to the floor joists to prevent sagging or other ceiling structure issues, or for any other construction-based reason, the dismantling of the existing roof 11 and installation of the new level floor joists may be performed iteratively in sections. In this alternative embodiment, a first portion of the existing roof 11 is dismantled and a first portion of the additional level is constructed (e.g., a first portion of floor joist(s) installed) and the bottom chord underneath the dismantled first portion of the existing roof 11 is tied to the newly installed first portion of the additional level. Continuing with the alternative embodiment, a second portion of the existing roof 11 is dismantled and a second portion of the additional level floor joists are installed, and the bottom chord underneath the dismantled second portion of the existing roof is tied to the newly installed second portion of the additional level floor joists. Still continuing with the alternative embodiment, additional portions of the existing roof 11 are removed and existing portions of the new additional level are installed until the existing roof 11 is completely dismantled and the new floor joists are installed. This process of concurrently removing the existing roof and installing the additional level floor joists and tying the bottom chord to the additional level floor joists in portions prevents the bottom chord and attached ceiling of the lower existing level from sagging or having other structural issues. Additionally, by removing of the existing roof 11 and installing the additional level floor joists in sections, the horizontal force applied by the installed new exterior assembly is further negated, because the new floor joists and existing roof 11 independently pull the building together in the opposite horizontal direction of the horizontal force applied by the new exterior assembly.

In many embodiments, once the floor joists are installed, the decking of the additional level may be installed, as one having ordinary experience in the art would know.

In several embodiments, upon completion of the additional level floor joists and decking, a new wall is built that extends from the existing load-bearing structures to the new exterior assembly 17. In the preferred embodiment, the new wall is referred to as a "knee wall", but other structural walls that resolve the load from the additional level down into the perimeter of the existing load-bearing structures are contemplated by the present disclosure. In some embodiments, once the knee wall is constructed, the one or more householders 13 may become redundant, as the knee wall serves as the primary load-bearing structure for the additional level.

In multiple embodiments, once the knee walls are constructed, some or all of the one or more householders 13 may be removed, but if the removal of the one or more householders 13 is impractical, dangerous or uneconomical, the one or more householders 13 may remain in the building as a part of the structure. In at least one embodiment, if the leveling mechanisms on the one or more householders 13 have not been permanently secured (e.g., via welding), the householders 13 can be removed and reused.

In many embodiments, the process for removing the one or more householders 13 may occur after the new load-bearing wall (the knee wall) is in place, but before sheathing (e.g., dry wall) is placed, so access to the householders 13 is non-disruptive. In certain embodiments, the fasteners connecting the perimeter beam 14 to the householder 13 are removed, then leveling mechanism is lowered so that the beam mounting bracket 47 is not holding the perimeter beam 14, and the fasteners connecting the householder 13 to the load-bearing structure below are removed and the householder 13 taken out.

In various embodiments, once step 110 is complete, the process 100 is complete.

Turning to FIG. 2, an exploded view of an exemplary building 200 with a new roof installed via the disclosed process is shown, according to one embodiment of the present disclosure. In various embodiments, the building 200 with the new exterior assembly 17 installed via the disclosed process 100 includes existing roof 11, one or more roof holes 12 cut into the existing roof 11, one or more householders 13, one or more perimeter beams 14, a new roof outer framing 15, and a new roof cladding 16. In one or more embodiments, the new outer framing 15 and the new roof cladding 16 may be the new exterior assembly 17. In one embodiment, as shown in FIG. 2, the building 200 includes both the existing roof 11 and the new exterior assembly 17, indicating that the building 200 is at step 106 of process 100.

Turning now to FIGS. 3A-3E, perspective views of an exemplary building 300 at various stages of process 100 are shown, according to one embodiment of the present disclosure.

Figure 3A:
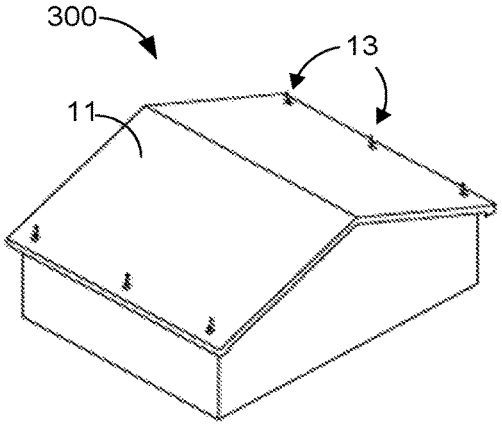
FIGS. 3A-3F are perspective views of an exemplary building at various stages of the disclosed process, according to one embodiment of the present disclosure.

As shown in FIG. 3A, in various embodiments, the building 300 has one or more householders 13 installed onto the load-bearing structures of the building 300 via the one or more roof holes 12 (not shown in FIG. 3A). In one or more embodiments, FIG. 3A correlates to step 102 in process 100. As shown in FIG. 3A, the building 300 includes three householders 13 installed through the existing roof 11 on each of two directly opposing sides of the building 300; however, it is understood that one or more householders 13 may be installed on any or all sides of a building as necessary to add an additional story via process 100.

Figure 3D:
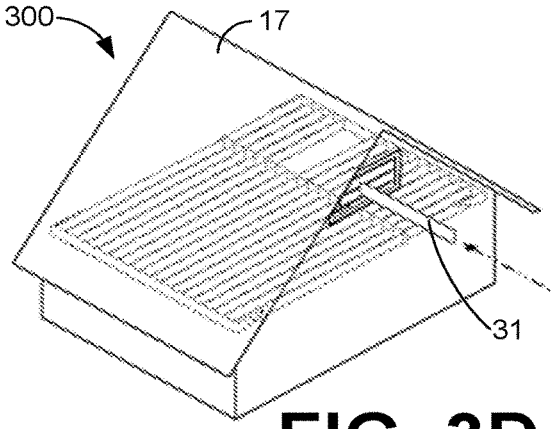
Figure 3B:
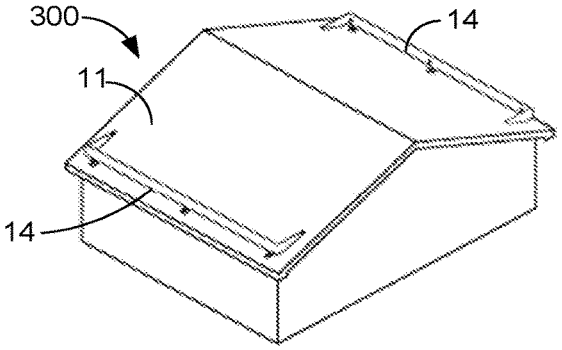

As shown in FIG. 3B, in multiple embodiments, one or more perimeter beams 14 have been installed on the one or more householders 13. In some embodiments, FIG. 3B correlates to step 104 in the process 100. In the embodiment as shown in FIG. 3B, one perimeter beam 14 is on the three householders 14 on one side of the building 300 (e.g., on one side of the existing roof 11), and the other perimeter beam 14 is on the three householders 14 on the opposing side of the building 300.

Figure 3E:
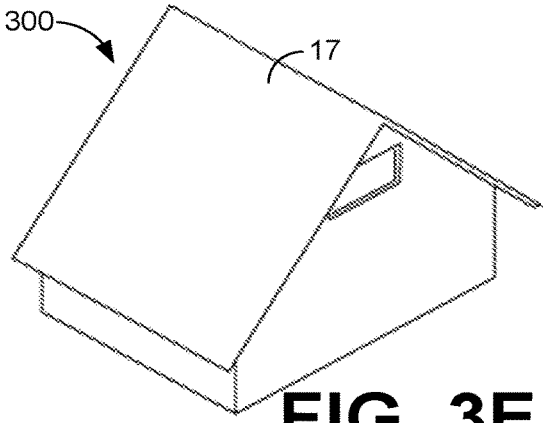
Figure 3C:
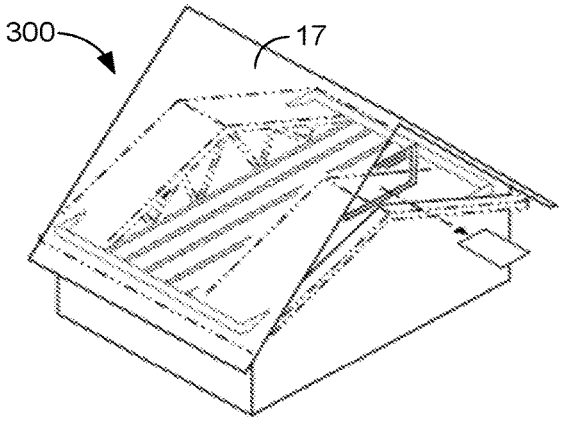

As shown in FIG. 3C, in multiple embodiments, a new exterior assembly 17 is installed on the one or more perimeter beams 14, and the existing roof 11 is partially dismantled, which correlates to steps 106 (new exterior assembly 17 addition) and 108 (existing roof 11 removal) of the process 100. In some embodiments, the new exterior assembly 17 is depicted in FIG. 3C as an A-frame type roof, but it will be understood that new exterior assembly 17 may be any roof-type available for buildings.

As shown in FIG. 3D, in various embodiments, the new exterior assembly 17 is installed, the existing roof 11 is dismantled, and the additional level is being added in building 300, as shown by the building materials 31 being passed through an unfinished window into the interior space under the new exterior assembly 17. In many embodiments, as shown in FIG. 3D, the building 300 correlates to step 110 of process 100. In one or more embodiments, the building materials 31 may also be passed through a finished window, or any other opening into the interior space under the new exterior assembly 17.

As shown in FIG. 3E, in several embodiments, the construction of the additional story in building 300 is complete.

Figure 3F:
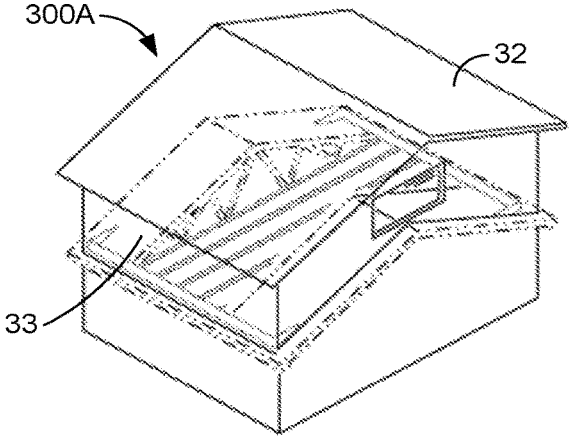

As shown in FIG. 3F, an alternative embodiment is shown of a new exterior assembly 32 installed onto a building 300. In this alternative embodiment, the new exterior assembly 32 includes outer framing, outer cladding, and vertical perimeter walls 33. In many embodiments, the addition of new exterior assembly 32 is within the scope of step 106 of process 100, as any roof-type may be installed in step 106. In some embodiments, the addition of the vertical perimeter walls 33 in the new exterior assembly 32 allows for the footprint of the additional level to be the same as, or nearly the same as, the footprint of the existing lower level. In one or more embodiments, installation of the new exterior assembly 32 may include installing the vertical perimeter walls 33 onto the one or more perimeter beams 14.

Turning now to FIG. 4, an exploded view of an exemplary householder 13 is shown, according to one embodiment of the present disclosure. In various embodiments, a householder 13 may include a beam mounting bracket 47, an adjustment collar 42, and a base mounting bracket 43. In one or more embodiments, the one or more householders 13 may be utilized to support and transfer the load of the additional level and new exterior assembly. In at least one embodiment, an individual householder 13 may be rated to support up to 35,000 pounds. In some embodiments, the one or more householders 13 may be made of steel, aluminum, titanium, or other similar materials, or combinations thereof.

In multiple embodiments, a beam mounting bracket 47 is the point of contact between the householder 13 and the one or more perimeter beams 14. In at least one embodiment, the beam mounting bracket 47 may include a rigid vertical member 44, a D-ring element 45 attached to the rigid vertical member 44, a rigid horizontal base member 46, and a rigid tube sleeve 48. In one embodiment, each of the rigid vertical member 44, a D-ring element 45 attached to the rigid vertical member 44, a rigid horizontal base member 46, and a rigid tube sleeve 48 may have a thickness between 0.1 and 0.25 inches, but it will be understood that the thickness can be larger or smaller, depending on the needs of the construction.

In one or more embodiments, the rigid vertical member 44 may include the D-ring element 45, a vertical fastening plate 82, and one or more vertical fastening wall support walls 83. In certain embodiments, the vertical fastening plate 82 may define one or more openings (herein called "one or more vertical member fastening holes 81") through the vertical fastening plate 82. In some embodiments, the perimeter beam 14 may be placed onto the top surface of the rigid horizontal base member 46 and fastened to the rigid vertical member 44. In many embodiments, the perimeter beam 14 may be fastened to the rigid vertical member 44 by fastening fasteners, such as bolts, screws, nails, or other similar fasteners, through the one or more vertical member fastening holes 81. In at least one embodiment, the one or more vertical member fastening holes 81 may be large enough to accept a variety of fastener types, which can accommodate a variety of perimeter beam material compositions.

In multiple embodiments, the vertical fastening plate 82 may include a first end and an opposing second end, in which the first end is attached to a top surface 91 of the rigid horizontal base member 46. In at least one embodiment, the vertical fastening plate 82 may also include a first edge and a second edge, in which the first edge is connected to a first edge of a first one or more vertical fastening surface support members 83, and the second edge is connected to a first edge of a second one or more vertical fastening support members 83. In several embodiments, the vertical fastening plate 82 may include a front surface that is in contact with the perimeter beam 14 when the perimeter beam is installed, and a back surface. In many embodiments, each of the one or more vertical fastening wall support members 83 may include a first end attached to the top surface 91 of the rigid horizontal base member 46, and an opposing second end, and a first edge that is connected with one of the first or second edges of the vertical fastening plate 82, and a second edge that tapers in towards the second end of the vertical fastening support plate 82. In certain embodiments, the D-ring element 45 protrudes out from the back surface of the vertical fastening plate 82. In one embodiment, the D-ring element 45 may have a first end and a second end, each connected to the back surface of the vertical fastening plate 82, and a body therebetween the first and second ends that is curved. In certain embodiments, when the first end and the second end of the D-ring element 45 is connected to the back surface of the vertical fastening plate 82, the back surface of the vertical fastening plate 82 and the body of the D-ring element combine to define an opening, such that a hook or other device may be connected to the D-ring from a chain winch 61.

In many embodiments, the rigid vertical member 44 may have a height that is the distance between the first end and the second end of the vertical fastening plate 82. In at least one embodiment, the height of the rigid vertical member 44 may be within the range of ten inches to forty-eight inches. In a preferred embodiment, the height of the rigid vertical member 44 may be fourteen inches. In one or more embodiments, the rigid vertical member 44 may have a width of two inches to twenty-four inches. In at least one embodiment, the rigid vertical member 44 may have a thickness of 0.1 inches to two inches.

In various embodiments, the rigid vertical member 44 may securely accommodate the perimeter beam 14 that holds the floor joists of the additional level and may securely accommodate a sufficient number of fasteners to safely protect against a tear-away condition between the perimeter beam 14 and the householder 13. In one embodiment, the height of the vertical member 44 may depend on the height of the perimeter beam 14, as it may be preferable to use a smaller height vertical member 44 with a smaller height perimeter beam 14.

In one or more embodiments, the D-ring element 45 may receive an attachment to a chain or cable (e.g., a hook). In many embodiments, the cables or chains from the chain winch may be attached at other points on the householder 13 or around the perimeter beam 14.

In many embodiments, the rigid horizontal base member 46, which connects the vertical member 44 to the rigid tube sleeve 48 and provides a sufficient surface area for one or more perimeter beams 14 to sit on top of without slipping off when securely fastened to the vertical member 44. In at least one embodiment, the rigid horizontal base member 46 includes a top surface 91 and a bottom surface 92. In certain embodiments, the rigid vertical member 44 is attached to the top surface 91 of the rigid horizontal base member 46, and the rigid tube sleeve 48 is attached to the bottom surface 92 of the rigid horizontal base member 46. In one embodiment, the members may be attached via welding or other similar processes. In some embodiments, the rigid horizontal base member 46 may have a height of two inches to twenty-four inches and may have a width of two to twenty-four inches. In at least one embodiment, the rigid horizontal base member 46 may have a thickness of 0.1 inches to two inches. In many embodiments, the rigid horizontal base member 46 may be square-shaped, though it may also be rectangular or any other shape that sufficiently holds the one or more perimeter beams 14.

In several embodiments, the rigid tube sleeve 48 may have a cylindrical body having an open first end to accept the adjustment collar 42 into the hollow body via the first end opening, and a second end that is connected to the rigid horizontal base member 46. In at least one embodiment, the rigid tube sleeve 48 may have a low tolerance machined interior surface, which allows the beam mounting bracket 47 to be connected to the base mounting bracket 43. In at least one embodiment, the connection to the base mounting bracket 43 may transmit the load of the one or more perimeter beams 14 and new exterior assembly 17 onto the adjustment collar 42 with minimal movement in any non-vertical direction. In some embodiments, the rigid tube sleeve 48 may have a thickness of 0.1 inches to two inches.

In multiple embodiments, the base mounting bracket 43 connects the householder 13 to the existing load-bearing structure of the building. In at least one embodiment, base mounting bracket 43 may include a base plate 95 and a base mount rod 96. In one or more embodiments, the base plate 95 may have a bottom surface that is in contact with the load-bearing structure when installed, and a top surface. In some embodiments, the base mount rod 96 protrudes vertically from the top surface of the base plate 95. In many embodiments, the base plate 95 may define one or more base plate holes 97. In one embodiment, a user may attach the base plate 95 to the load-bearing structure via fasteners, such as bolts, screws, nails, concrete fasteners, wood fasteners, or other similar fasteners, through the one or more base plate holes 97. As shown in FIG. 4, in one embodiment, the base plate 95 has eight base plate holes 97, but more or less base plate holes 97 may be defined by the base plate 95 as necessary to sufficiently attach the base plate 95 to the load-bearing structure. In some embodiments, the one or more base plate holes 97 may be circular, square, rounded slots, or any other shape that may be used to allow a fastener to go through one of the one or more base plate holes 97.

In several embodiments, the base plate 95 of the base mounting bracket 43 may have a length of six inches to eight feet. In many embodiments, it may be preferred to install a baseplate 95 that is as long as possible along the length of the load-bearing structure to provide a greater load-bearing area, but should also be small enough to fit through the roof hole 12. In a preferred embodiment, the length of the base plate 95 is twelve inches to thirty-two inches. In at least one embodiment, the base plate 95 may have a thickness of 0.1 inches to two inches. In a preferred embodiment, the base plate 95 may have a thickness of 0.25 inches. In some embodiments, vertical reinforcement plates may be added between the base of the base mount rod 95 (below the bottom of the threads) and the base plate 95. In many embodiments, the base plate 95 may have a width of three inches to two inches.

In multiple embodiments, the base mount rod 96 may be a vertical member protruding from the top surface of the base plate 95 that operatively connects to the adjustment collar 42. In some embodiments, the base mount rod 96 may provide functionality to allow the adjustment collar 42 to provide vertical adjustment of the householder 13. In a preferred embodiment, the base mount rod 96 may have a cylindrical body that has machined threads on the body surface so that the adjustment collar 42 may rotate around the base mount rod 96 to adjust the householder vertically.

In several embodiments, the adjustment collar 42 may allow vertical adjustment of the householder 13 to level the householder 13 with the other one or more householders 13. In at least one embodiment, the adjustment collar 42 may be the preferred embodiment of the leveling mechanism. In many embodiments, the adjustment collar 42 includes a hollow body with a first and second end, an interior threaded surface, and an outer surface. In one or more embodiments, the first and second ends of the adjustment collar 42 define openings such that the base mount rod 96 may pass through the interior of the adjustment collar 42. In some embodiments, the outer surface of the adjustment collar 42 may include a first portion that has an outer diameter that is smaller than the diameter of the opening of the rigid tube sleeve 48, and a second portion that has an outer diameter that is larger than the diameter of the opening of the rigid tube sleeve 48, so that the first portion may pass through the opening of the rigid tube sleeve 48, the second portion abuts the opening of the rigid tube sleeve 48 once the first portion is within the tube sleeve 48.

In various embodiments, the interior threaded surface of the adjustment collar 42 may include machined threads that mate with the base mount rod 96. In some embodiments, the base mount rod 96 may have a diameter that is smaller than the diameter of the openings of the adjustment collar 42, so that the adjustment collar 42 fits onto the base mount rod 96. In one embodiment, the threads on the interior surface of the adjustment collar 42 may mate with the threads on the outer surface of the base mount rod 96, such that when the adjustment collar 42 is on the base mount rod 95, rotating the adjustment collar 42 causes the adjustment collar 42 to move vertically along the base mount rod 95. In certain embodiments, the adjustment collar 42 may be rotated by a user by hand, or may be rotated via a motor or other similar device.

Figure 5:
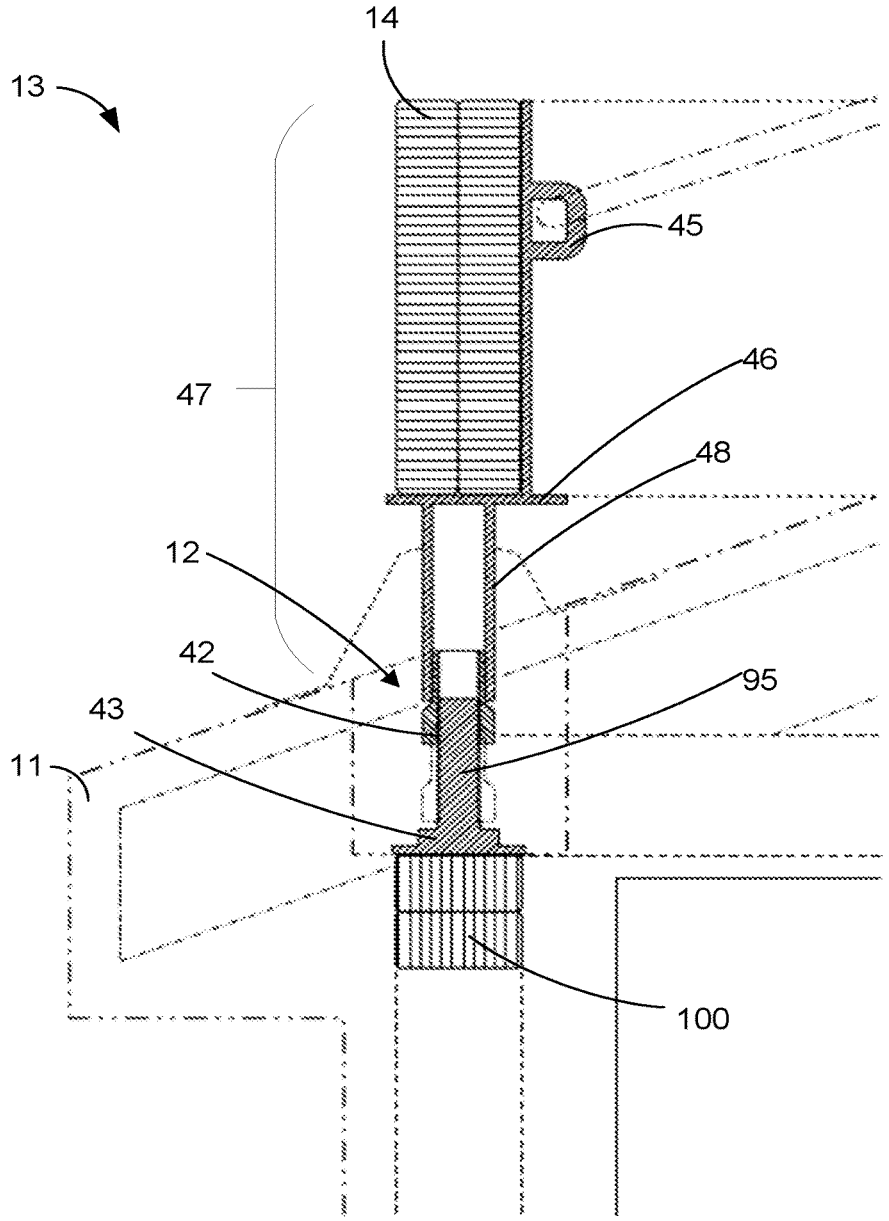
FIG. 5 is a side view of an exemplary householder installed on a building, according to one embodiment of the present disclosure.

Turning now to FIG. 5, a side view of an exemplary householder 13 installed on a building is shown, according to one embodiment of the present disclosure. In various embodiments, as shown in FIG. 5, the householder 13 includes the beam mounting bracket 47, an adjustment collar 42, and a base mounting bracket 43. In some embodiments, the base mounting bracket 43 is slipped into the roof hole 12 through the existing roof 11 (e.g., through the existing roof membrane and decking/panels) and mounted to the existing load-bearing structure 55. In one embodiment, the roof hole 12 enables a user to adjust the adjustment collar 42 manually from above, rather than from the side or below, because the location of the adjustment collar 42 once the householder 13 is installed cannot be easily accessed by a user due to the tight confines within roofing systems. However, in one embodiment, if a particular roofing system allows for easy access to the householder 13 post installation, a user could adjust the adjustment collar from below or from the side of the householder 13. In certain embodiments, fasteners used to secure the base mounting bracket 43 to the existing load-bearing structure 55 are sufficient to prevent slipping of the householder 13 while installation is underway. In some embodiments, as shown in FIG. 5, the existing load-bearing structure 55 is a combination of two members, but it should be understood that the load-bearing structure 55 may be any conventional load-bearing structure. In one embodiment, the chain winch 61 may also provide support and tension to the structure and system during installation.

In many embodiments, the exterior threads of the base mount rod 96 are fitted to the inner threads of the adjustment collar 42, providing maximum resistance to failure. In several embodiments, as shown in FIG. 5, the adjustment collar 42 is in an adjusted state. In one or more embodiments, the second portion of the adjustment collar 42 that does not fit into the rigid tube sleeve 48 includes a flange that abuts against the open end of the rigid tube sleeve 48 and provides the vertical support to the beam mounting bracket 47. In some embodiments, the adjustment collar 42 includes an affordance, which enables the adjustment collar 42 to be welded or otherwise secured to the rigid tube sleeve 48 in situations where torsional forces might cause the adjustment collar 42 to rotate and cause the householder to become unlevel. In one embodiment, the adjustment collar 42 is utilized to level the householder 13 before the load of the perimeter beams 14 or the new exterior assembly 17 is placed onto the householder 13.

In various embodiments, the rigid tube sleeve 48 includes a machined interior surface that may provide a high-strength and low tolerance fit between the beam mounting bracket 47 and the adjustment collar 42. In at least one embodiment, the rigid tube sleeve 45 may have a length that is longer than the length of the base mount rod 95 so that the base mount rod 95 does not interfere with the beam mounting bracket 47.

In multiple embodiments, the beam mounting bracket 47 is shown with two perimeter beams 14 installed on the top surface of the rigid horizontal base member 46 and shows the D-ring element 45 protruding from the back surface of the rigid vertical member. It will be understood that although FIG. 5 shows two perimeter beams 14 installed, any type of structural beam is contemplated by this disclosure.

Figure 6A:
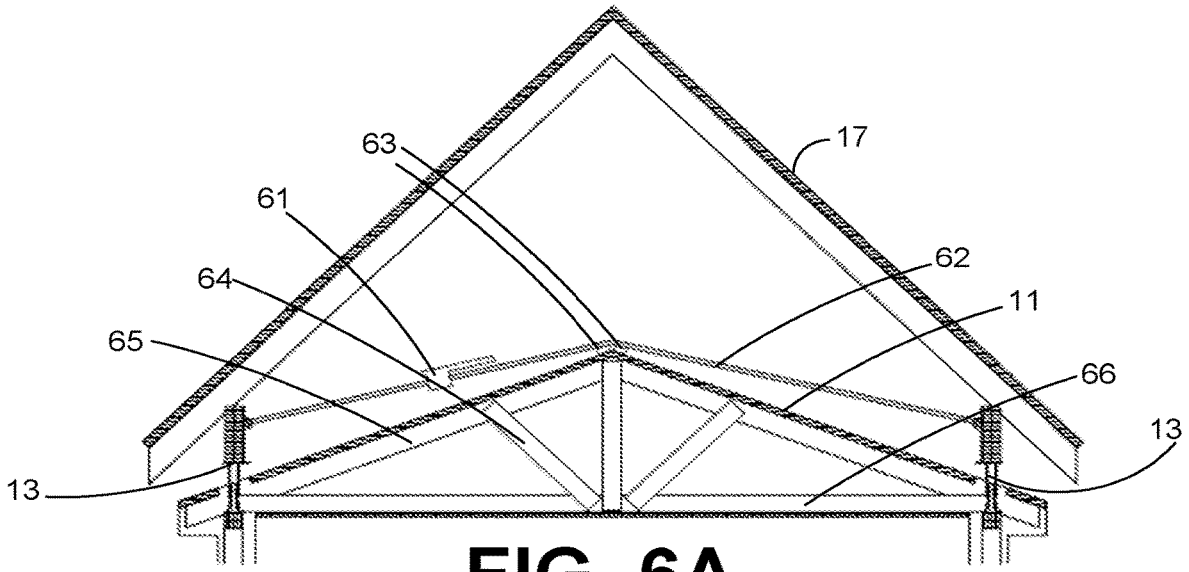
FIGS. 6A and 6B are front views of an exemplary building, according to one embodiment of the present disclosure.
Figure 6B:
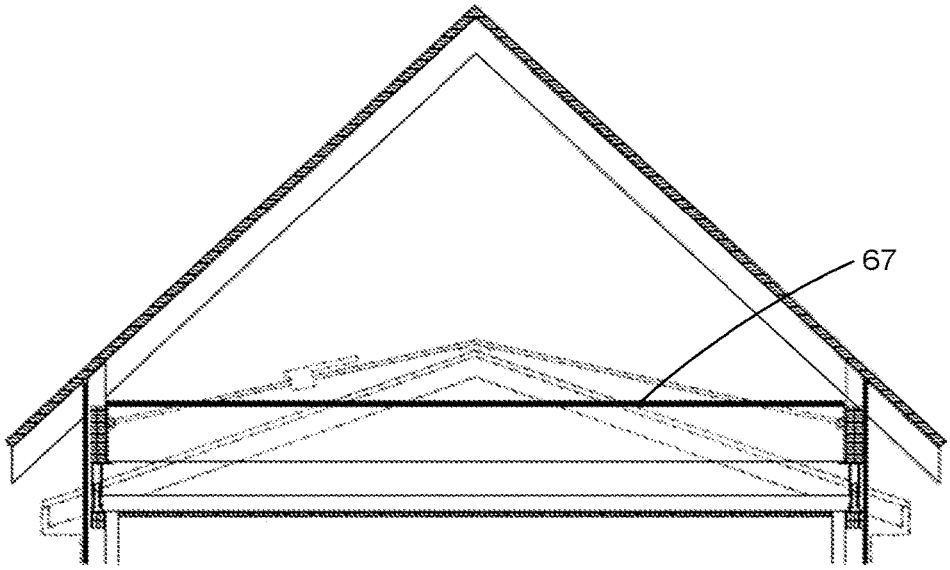

Turning now to FIGS. 6A and 6B, front views of an exemplary building 600 are shown, according to one embodiment of the present disclosure. As shown in FIG. 6A, a chain winch 61 is attached to two householders 13 via the D-ring elements 45 on each of the householders 13, and the existing roof 11 is still attached to the house. In multiple embodiments, the chain winch 61 serves to pretension a flexible line 62 (e.g., steel cable or chain) between the householders 13 to prevent the one or more perimeter beams 14 from "rolling" outward as the new exterior assembly 17 loads apply horizontal loads to the perimeter beams 14. In some embodiments, protective elements 63 may assist in spreading the load of the flexible line 62 across the outer surface of the existing roof 11. In at least one embodiment, the protective elements 63 may also protect the flexible line 62 from having a single point of contact at the vertex of the existing roof 11, so that the flexible line 62 has a lesser likelihood of being damaged.

In various embodiments, the existing roof 11 includes framing web chords 64 and upper chords 65, which are dismantled, while the bottom chord 66 of the existing roof 11 is not dismantled (to support the ceiling plane of the existing interior space) when the existing roof 11 is dismantled. In another embodiment, the bottom chord 66 of the existing roof 11 is also dismantled when the existing roof 11 is dismantled.

In some embodiments, the new exterior assembly 17 is on the perimeter beams 14. In one or more embodiments, the new exterior assembly 17 includes the outer cladding 16 and the outer framing 15. In one embodiment, as shown in FIGS. 6A and 6B, the outer framing 15 is in the shape of an A-frame type roof, though it is understood that the outer framing 15 may include the shape of any roof-type and may include additional vertical walls (see FIG. 3F) to support a full additional level.

As shown in FIG. 6B, the existing roof 11 has been dismantled and the chain winch 61 unattached from the householders 13, and floor joists 67 and floor decking of the new level have been installed. In various embodiments, the floor joists 67 may be attached to the perimeter beams 14, which resolves the horizontal load placed on the perimeter beams 14, so that the chain winch 61 may be removed.

Figure 7:
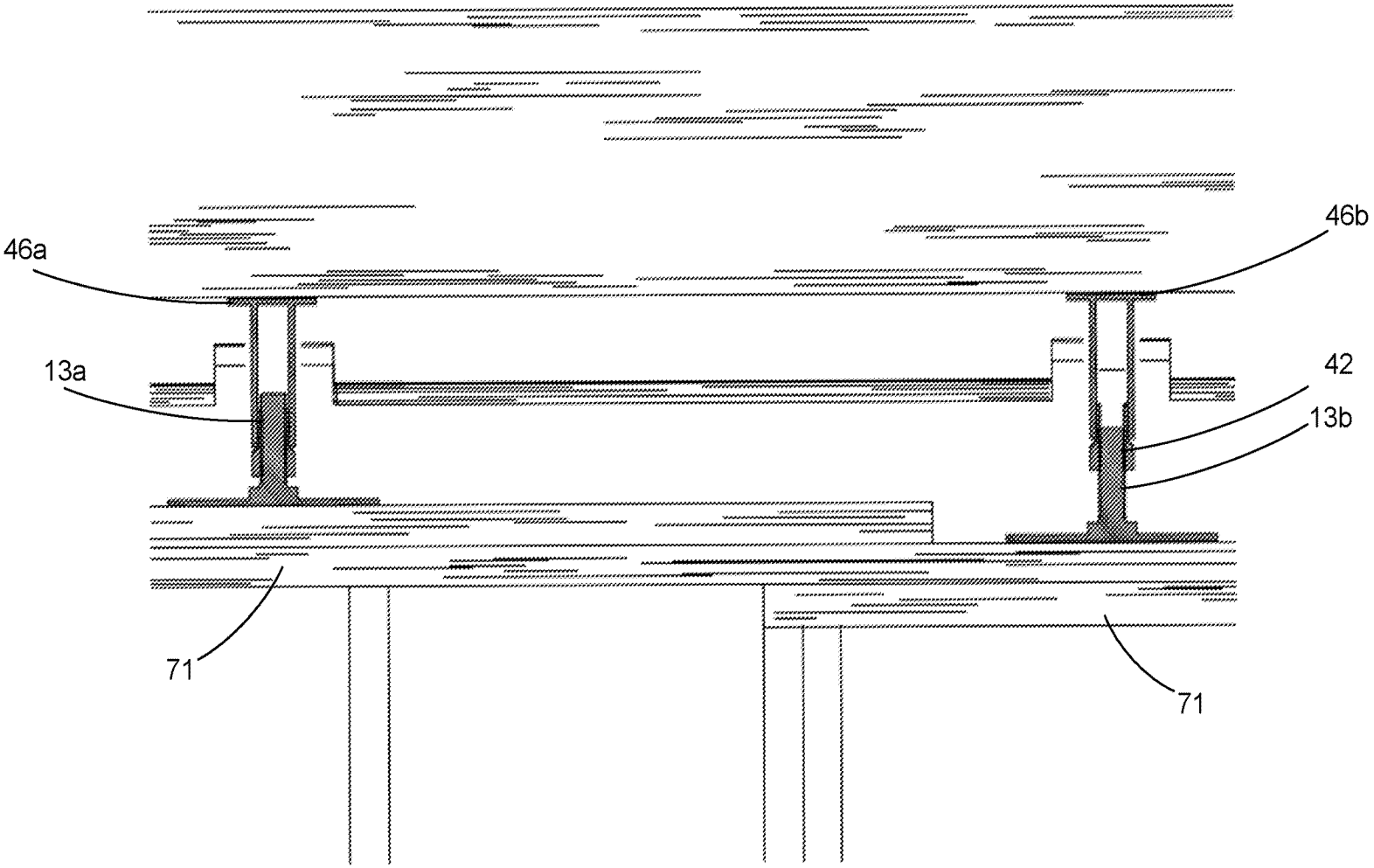
FIG. 7 is a side view of exemplary leveled householders installed on a building, according to one embodiment of the present disclosure.

Turning now to FIG. 7, a side view of exemplary leveled householders 13 is shown, according to one embodiment of the present disclosure. As shown in FIG. 7, in one or more embodiments, buildings may have load-bearing structures that are not uniformly level (due to foundation settling or built-in inconsistent load-bearing structures, or any other cause), so that, without adjusting the height of the householders 13 when installed, the one or more perimeter beams 14 and additional level would not be level if installed on the unleveled householders 13. In many embodiments, as shown in FIG. 7, a first householder 13*a* is installed on a first portion of the load-bearing structure 71 having a first height, and a second householder 13*b* is installed on a second portion of the load-bearing structure 71 having a second height, and the first height is higher than the second height. In many embodiments, because the first householder 13*a* is installed at a higher point than the second householder 13*b*, the first householder 13*a* and second householder 13*b* are adjusted vertically via the adjustment collar 42 so that the first householder 13*a* and the second householder 13*b* are level. In one embodiment, the first householder 13*a* and the second householder 13*b* may be considered level when the rigid horizontal base member 46*a* is approximately level with the rigid horizontal base member 46*b*. Although FIG. 7 shows two householders 13 (householders 13*a* and 13*b*), any number of householders 13 may be leveled with each other prior to installing the one or more perimeter beams 14.

What is claimed is:

1. A method for constructing an additional level in a building, comprising:

installing one or more householders onto an existing roof of the building, wherein each of the one or more householders comprise an attachment point;

installing one or more perimeter beams onto the one or more householders;

attaching a winch and flexible line to the attachment points of the one or more householders to stabilize the one or more perimeter beams;

installing a new exterior assembly onto the one or more perimeter beams;

removing the existing roof from the building; and constructing an additional level within the building.

2. The method of claim 1, wherein the existing roof is removed from the building before the additional level is constructed within the building.

3. The method of claim 1, wherein portions of the existing roof are removed from the building as portions of the additional level are constructed within the building.

4. The method of claim 1, wherein installing one or more householders comprises:

cutting one or more roof holes through the existing roof of the building;

inserting the one or more householders into the existing roof through the one or more roof holes;

attaching the one or more householders to a load-bearing structure of the building; and sealing the one or more roof holes.

5. The method of claim 1, further comprising leveling each of the one or more householders prior to installing the one or more perimeter beams.

6. The method of claim 5, wherein leveling each of the one or more householders comprises adjusting a leveling mechanism on each of the one or more householders.

7. The method of claim 1, wherein each of the one or more householders further comprise:

a beam mounting bracket, wherein the beam mounting bracket comprises a rigid vertical member, a rigid horizontal base member, and a rigid tube sleeve;

a leveling mechanism, wherein the leveling mechanism operatively connects with the rigid tube sleeve; and a base mounting bracket, wherein the base mounting bracket comprises a base plate and a base mounting rod protruding from the base plate, wherein the base mounting rod operatively connects with the leveling mechanism.

8. The method of claim 7, wherein the leveling mechanism comprises a hollow body with a machine threaded interior surface, and the base mounting rod comprises an exterior machine threaded surface, wherein the interior threaded surface of the leveling mechanism mates with the machine threaded exterior surface of the base mounting rod.

9. The method of claim 8, wherein the rigid vertical member comprises a vertical fastening plate, one or more vertical fastening support plates, and an attachment point protruding from the vertical fastening plate, wherein the vertical fastening plate defines one or more fastening holes for fastening the rigid vertical member to the one or more perimeter beams.

* * * * *